US009179786B1

(12) United States Patent
Ransil et al.

(10) Patent No.: US 9,179,786 B1
(45) Date of Patent: Nov. 10, 2015

(54) COLLAPSIBLE NAPPER FOR A PLAYARD BASSINET

(71) Applicant: ARTSANA USA, INC., Lancaster, PA (US)

(72) Inventors: Matthew J. Ransil, Richland, PA (US); Jeff G. Greger, Lititz, PA (US)

(73) Assignee: ARTSANA USA, INC., Lancaster, PA (US)

( * ) Notice: Subject to any disclaimer, the term of this patent is extended or adjusted under 35 U.S.C. 154(b) by 309 days.

(21) Appl. No.: 13/974,769

(22) Filed: Aug. 23, 2013

Related U.S. Application Data

(60) Provisional application No. 61/693,227, filed on Aug. 24, 2012.

(51) Int. Cl.

| | |
|---|---|
| ***A47D 7/00*** | (2006.01) |
| ***A47D 9/00*** | (2006.01) |
| *A47D 13/06* | (2006.01) |
| *A47D 7/04* | (2006.01) |

(52) U.S. Cl.
CPC . *A47D 9/005* (2013.01); *A47D 7/00* (2013.01); *A47D 7/002* (2013.01); *A47D 7/04* (2013.01); *A47D 9/00* (2013.01); *A47D 13/06* (2013.01); *A47D 13/061* (2013.01); *A47D 13/066* (2013.01)

(58) Field of Classification Search
CPC ..... A47D 9/005; A47D 9/00; A47D 7/00; A47D 7/002; A47D 7/04; A47D 13/061; A47D 13/066; A47D 13/06; A47D 13/063; A47D 13/065; A47D 13/068
See application file for complete search history.

(56) References Cited

U.S. PATENT DOCUMENTS 1,568,063 A * 1/1926 Fagen ..... A47D 9/005 280/647
3,004,793 A * 10/1961 Loomis ..... A47D 1/00 297/274
3,049,727 A * 8/1962 Ruddy ..... A47D 9/005 5/99.1
3,453,022 A * 7/1969 Lecuyer ..... A47C 4/24 297/46
4,132,429 A * 1/1979 Woods ..... B62B 7/08 280/647
5,207,478 A * 5/1993 Freese ..... A47D 13/107 297/16.1
5,454,124 A * 10/1995 Huang ..... A47D 13/063 5/98.1
5,474,404 A * 12/1995 Chien ..... A47D 13/063 16/328
5,507,564 A * 4/1996 Huang ..... A47D 1/002 297/256.13
5,509,721 A * 4/1996 Huang ..... A47D 1/002 297/188.1
5,513,399 A * 5/1996 Weng ..... A47D 13/063 5/98.1
5,526,542 A * 6/1996 Huang ..... A47D 13/063 5/98.1
5,778,465 A * 7/1998 Myers ..... A47D 7/04 5/93.1
5,781,944 A * 7/1998 Huang ..... A47D 13/063 5/98.1
5,918,329 A * 7/1999 Huang ..... A47D 5/00 5/503.1
5,947,552 A * 9/1999 Wilkins ..... A47C 7/66 297/16.1

(Continued)

*Primary Examiner* — David E Sosnowski
*Assistant Examiner* — Morgan McClure
(74) *Attorney, Agent, or Firm* — Andrew D. Mead

(57) ABSTRACT

A foldable napper accessory for a child's playard positions an infant to minimize the risk of falls. The napper frame is foldable from a generally planar deplyed orientation about one or more generally longitudinally extending frame folding axes. The ends of an elongate support leg are pivotally connected to opposing side rail members of the napper frame and configured to be foldable about a leg folding axis generally transverse to the frame. Pivoting about the leg folding axis angles the support leg from the plane of the deployed napper frame or aligns the leg with the plane of the napper frame for stowage. An intermediate folding joint is provided in the support leg which includes intermediate axis generally perpendicular to the leg folding axis that allows folding of the leg only when the leg is folded into a specific orientation.

15 Claims, 10 Drawing Sheets

(56) References Cited

U.S. PATENT DOCUMENTS 6,125,483 A * 10/2000 Stroud ..... A47D 13/063 135/128
6,263,525 B1 * 7/2001 Liu ..... A47D 13/063 5/98.1
6,336,234 B1 * 1/2002 Kuo ..... A47D 13/063 5/93.1
6,364,563 B1 * 4/2002 Cheng ..... A47D 13/063 403/102
6,588,033 B1 * 7/2003 Welsh, Jr. ..... A47D 7/002 5/93.1
D513,130 S * 12/2005 Canna ..... D6/333
7,065,805 B1 * 6/2006 Sundberg ..... A47K 3/127 297/256.12
8,001,630 B2 * 8/2011 Burkholder ..... A47D 7/04 5/93.1
8,307,475 B2 * 11/2012 Hutchinson ..... A47D 7/04 5/109
8,316,481 B2 * 11/2012 Arnold, IV ..... A47D 9/00 5/93.1
8,997,277 B2 * 4/2015 Thomas ..... A47D 5/00 5/414
9,066,607 B1 * 6/2015 Ransil ..... A47D 7/04 1/1
2002/0016991 A1 * 2/2002 Brown ..... E04H 15/006 5/99.1
2002/0166169 A1 * 11/2002 Longenecker ..... A47D 5/006 5/93.1
2003/0061658 A1 * 4/2003 Longenecker ..... A47D 13/063 5/99.1
2003/0106149 A1 * 6/2003 Hsia ..... A47D 9/005 5/99.1
2005/0011004 A1 1/2005 Favorito et al.
2006/0225204 A1 * 10/2006 Bretschger ..... A47D 9/02 5/93.1
2008/0000023 A1 * 1/2008 Chen ..... A47D 13/063 5/99.1
2008/0282468 A1 * 11/2008 Golias ..... A47D 13/063 5/111
2009/0000028 A1 * 1/2009 Wang ..... A47D 13/063 5/93.1
2009/0315008 A1 * 12/2009 Yu ..... A47D 13/063 256/67
2010/0017959 A1 * 1/2010 Yoshe ..... A47C 17/82 5/99.1
2010/0218311 A1 * 9/2010 Rivera ..... A47D 13/063 5/99.1
2012/0012801 A1 * 1/2012 Burns ..... A47D 13/063 256/25
2012/0036633 A1 * 2/2012 Horst ..... A47D 9/00 5/93.1
2012/0096646 A1 * 4/2012 Barron ..... A47D 9/005 5/655
2012/0211713 A1 * 8/2012 You ..... A47D 13/063 256/25
2012/0216346 A1 * 8/2012 Rampton ..... A47D 13/063 5/99.1
2012/0233770 A1 * 9/2012 Greger ..... A47D 9/00 5/98.1
2012/0248394 A1 * 10/2012 Thorne ..... A47D 13/061 256/25
2013/0047336 A1 2/2013 Burkholder et al.
2013/0221636 A1 * 8/2013 Driessen ..... B62B 7/08 280/650
2013/0239382 A1 * 9/2013 Cheng ..... A47D 7/002 29/426.1
2013/0333111 A1 * 12/2013 Cheng ..... A47D 13/063 5/99.1
2014/0047639 A1 * 2/2014 Cheng ..... A47D 13/063 5/99.1
2014/0283298 A1 * 9/2014 Cheng ..... A47D 13/063 5/111
2015/0113728 A1 * 4/2015 Mountz ..... A47D 5/00 5/93.1

* cited by examiner

COLLAPSIBLE NAPPER FOR A PLAYARD BASSINET

CROSS-REFERENCE TO RELATED APPLICATIONS

This application claims the benefit of priority of U.S. Provisional Application 61/693,227, filed Aug. 24, 2012.

BACKGROUND OF THE INVENTION

This invention relates generally to a children's playard, and more particularly to a napper accessory that is easily and securely connectible to the playard when a bassinet accessory is present in the playard.

Playards are small play areas for young children and generally include side walls and a bottom floor which serve as an enclosure for a child. Wall and floor panels are conventionally made of fabric material or similar soft goods connected to a plurality of frame members. The frame members are arranged to enable the frame to be collapsed into a more compact configuration for stowage or transport. It is known to enhance the usefulness of a playard by installing a bassinet therein to provide an elevated surface within the side walls and above the bottom floor from which infants are more readily accessible. As playards have increased in popularity, numerous other accessories have emerged to further enhance the versatility of the playard and broaden their appeal to consumers.

A napper is one such accessory designed to work with a playard, particularly when a bassinet is installed. A napper includes a frame supporting a sling-like pocket typically formed of cloth or similar soft material that holds an infant in a slightly head-elevated position to improve sleep. The napper may be attached to the playard frame, the bassinet frame, or a combination thereof so that, once positioned, the napper will remain structurally attached to the playard thereby providing a safe and secure environment for an infant to nap.

Many playard accessories presently offered do not feature collapsible frames which reduces stowable compactness and creates problems for users desiring portability of their playard system. Consequently, the need to provide collapsible frames for playard accessories offering the same level portability and compactness as the playard frame itself is a growing concern. Many benefits would be realized by a napper accessory for a playard that is conveniently collapsible into a compact form yet deployable into a configuration that is securely connectable to a playard without concern for unintentional detachment of the accessory frame and potential injury of an infant.

SUMMARY OF THE INVENTION

Accordingly, the present invention, in any of the embodiments described herein, may provide one or more of the following advantages. It is an object of the present invention to provide a foldable napper accessory for positioning in or on a child's playard that provides a secure cradle in which an infant may nap. The napper, once installed, is capable of remaining securely connected to the playard and positioning the infant so as to minimize the risk of falls from the napper or playard. The napper frame is selectively attachable at one end to an upper perimeter frame of a playard in a manner to position the napper within the playard frame perimeter. The napper frame end opposite the playard connection includes a support configured to rest upon the floor of an installed bassinet. Elevation differences between the upper playard frame and the bassinet floor surface allow the napper to incline so that the infant's head may be elevated. This configuration also positions the infant below the upper perimeter frame of the playard so that an infant remains within the confines of the playard and only slightly above the bassinet floor surface. The arrangement minimizes the risk of injury in the event of an infant fall from the napper.

It is a further object of the present invention to provide a foldable napper accessory for positioning in or on a child's playard that is easily installable. The napper frame is selectively attachable at one end to an upper perimeter frame of a playard in a manner to position the napper within the playard frame perimeter. The preferred connection to the playard frame includes a single connector positioned at one end of the napper frame. The connector includes a connector pin extending generally vertically and configured to engage a receptacle in the playard upper perimeter frame, preferably incorporated into a corner member. The connector pin/receptacle combination may include a locking detent or the like to prevent accidental disengagement. A support leg provided at the napper frame end opposite of the connector is supported by the floor of an installed bassinet. The support leg includes a horizontal portion that extends substantially the transverse width of the napper frame to provide stability.

It is a still further object of the present invention to provide a foldable napper accessory for positioning in or on a child's playard that is easily collapsible for stowage. The napper frame is foldable from a generally planar deployed perimeter about one or more generally longitudinally extending frame folding axes. An elongate support leg is pivotally connected at each end to the opposing side rail members of the napper frame and configured to be foldable about a leg folding axis generally transverse to the napper frame. Pivoting about the leg folding axis allows the support leg to be angled from the plane of the deployed napper frame or pivoted into the plane of the napper frame for stowage. An intermediate folding joint is provided in the support leg which includes intermediate axis generally perpendicular to the leg folding axis that allows folding of the leg only when the leg is folded into a specific orientation, typically when the leg is folded toward the stowed position and the intermediate axis aligns with the frame folding axis.

It is a still further object of the present invention to provide a foldable napper accessory for positioning in or on a child's playard that is durable in construction, inexpensive of manufacture, carefree of maintenance, easily assembled, and simple and effective to use. The folding napper frame comprises inexpensive tubular frame members connected by a plurality of folding hinge joints. Relative alignment of the joint folding axes prevents inadvertent folding of the napper when deployed, yet allows the frame to be easily collapsed for stowage by the proper sequence of joint folds.

These and other objects are achieved in accordance with the present invention by providing a foldable napper accessory for positioning in or on a child's playard that provides a secure cradle in which an infant may nap. The napper, once installed, is capable of remaining securely connected to the playard and positioning the infant so as to minimize the risk of falls from the napper or playard. The napper frame is selectively attachable at one end to an upper perimeter frame of a playard in a manner to position the napper within the playard frame perimeter. The napper frame end opposite the playard connection includes a support configured to rest upon the floor of an installed bassinet. The napper frame is foldable from a generally planar deployed perimeter about one or more generally longitudinally extending frame folding axes. An elongate support leg is pivotally connected at each end to the opposing side rail members of the napper frame and configured to be foldable about a leg folding axis generally transverse to the napper frame. Pivoting about the leg folding axis allows the support leg to be angled from the plane of the deployed napper frame or pivoted into the plane of the napper frame for stowage. An intermediate folding joint is provided in the support leg which includes intermediate axis generally perpendicular to the leg folding axis that allows folding of the leg only when the leg is folded into a specific orientation, typically when the leg is folded toward the stowed position and the intermediate axis aligns with the frame folding axis.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the playard would normally rest on the floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures. The use of "a" and "b" suffixes with part numbering signifies multiple instances of the same or a mirror image part in the assembly.

Figure 1:
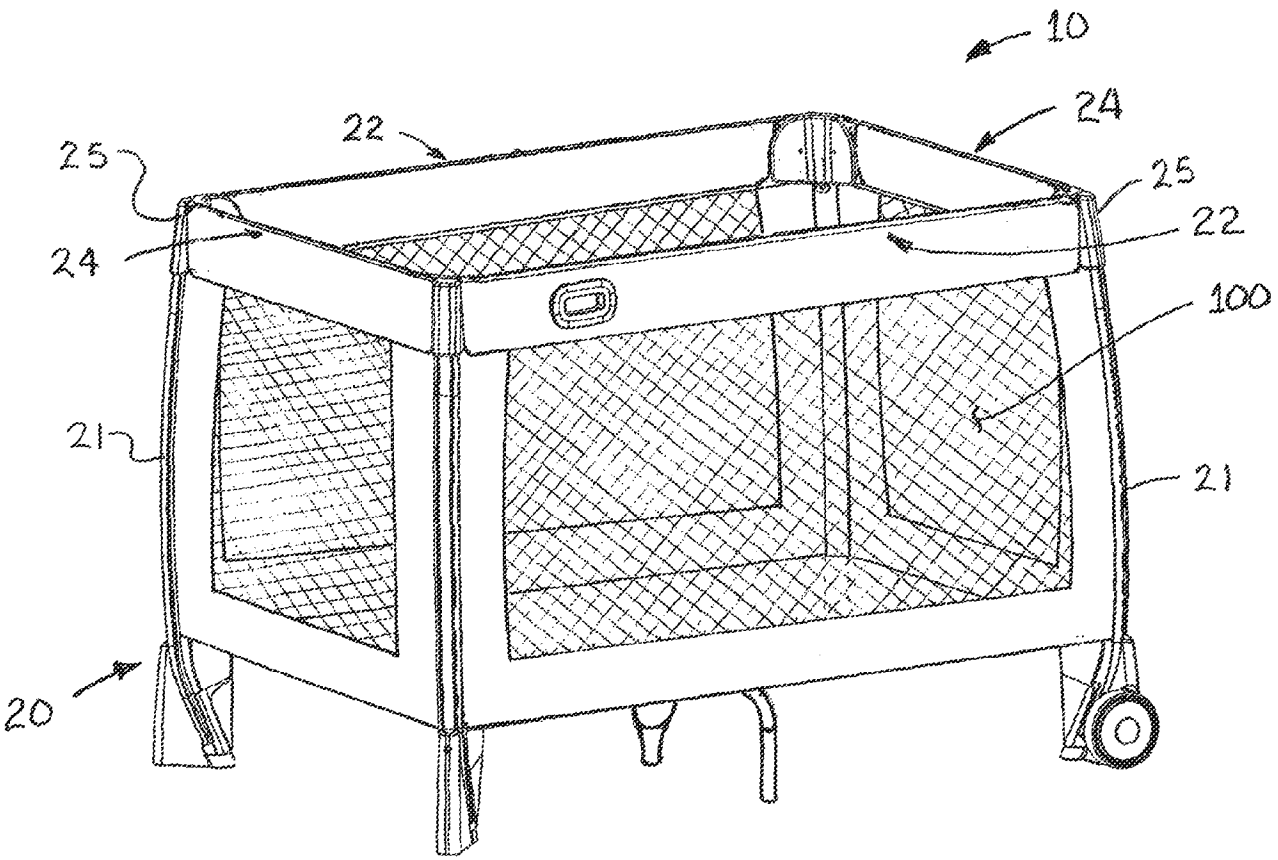
FIG. 1 is a perspective view of a conventional playard on which the present invention is useful.
Figure 2:
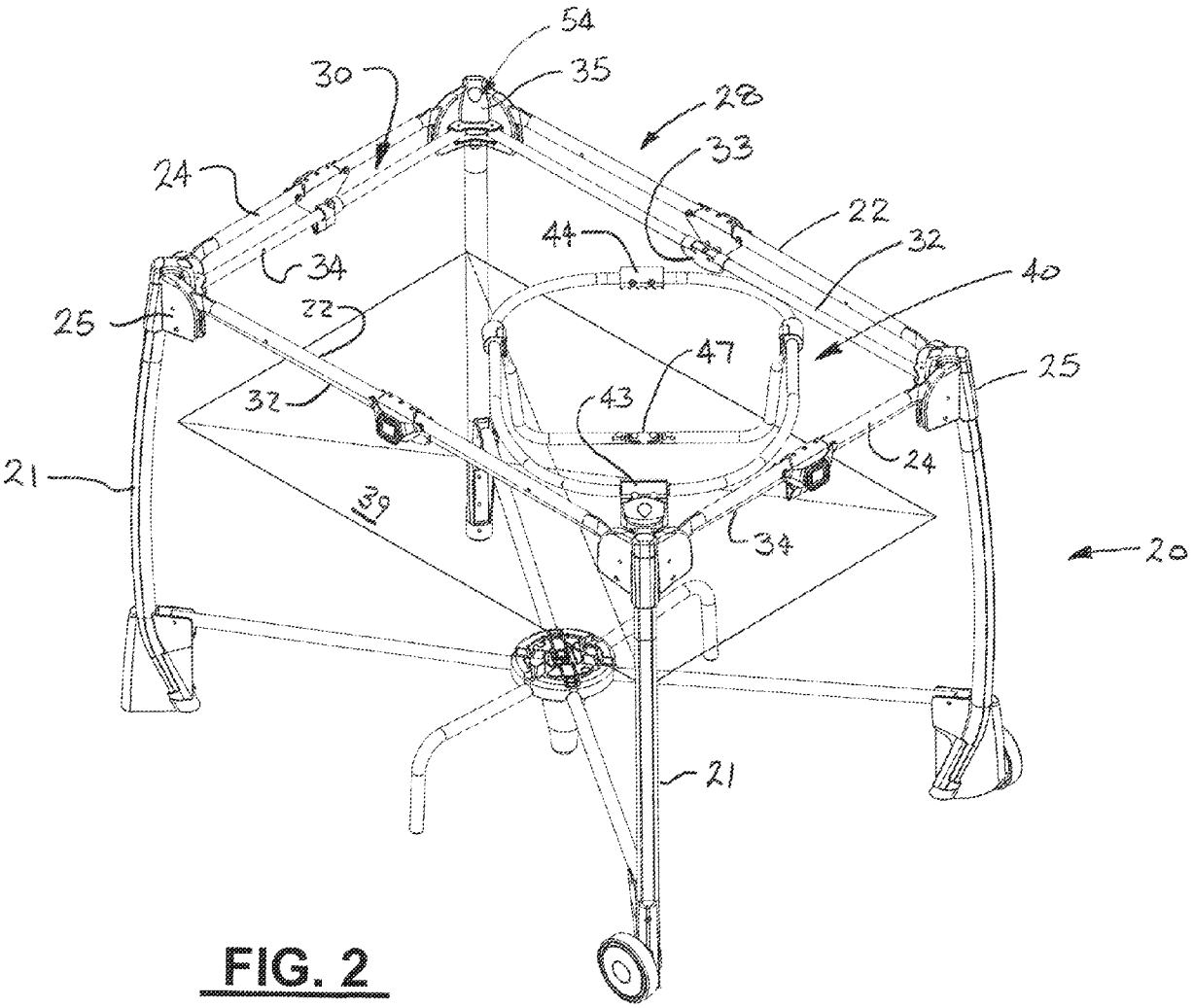
FIG. 2 is a perspective view of a foldable accessory frame embodying aspects of the present invention deployed for use on the playard frame of FIG. 1, shown having the soft goods removed.
Figure 3:
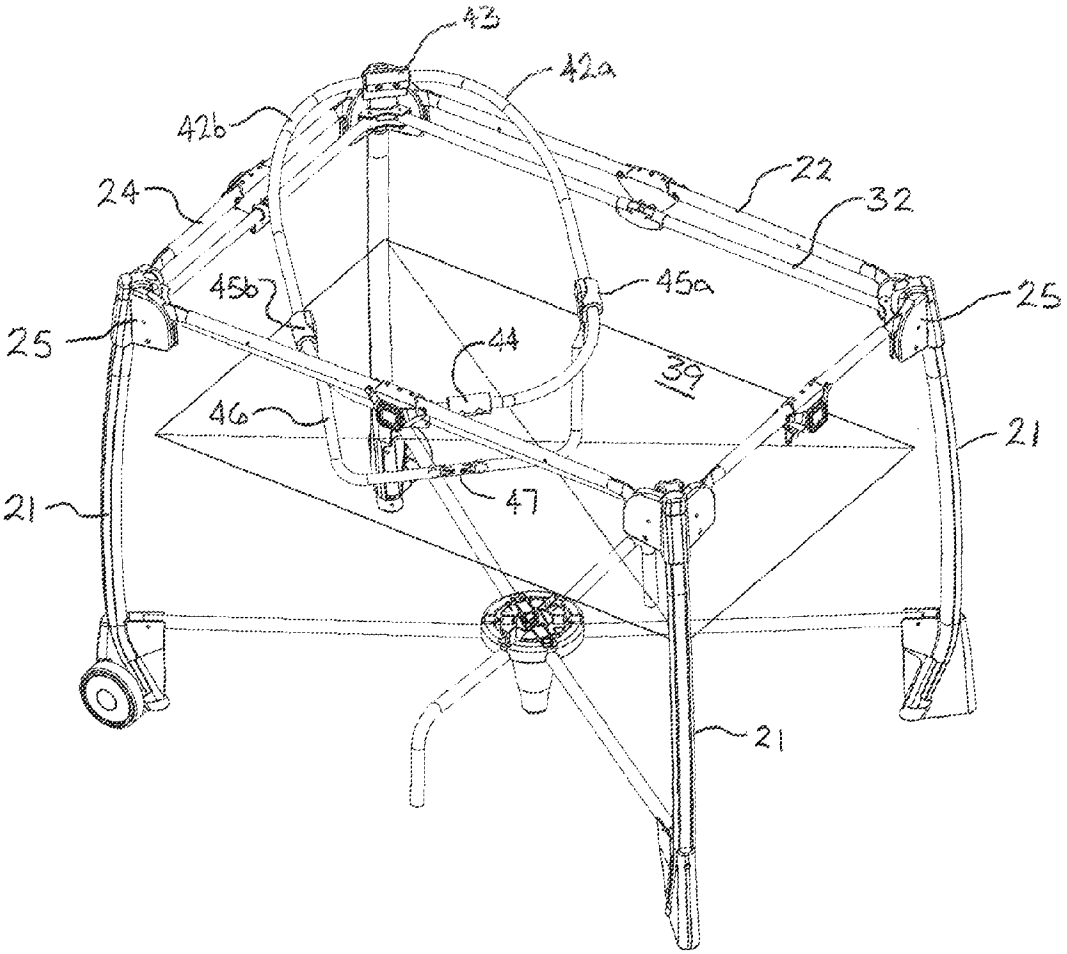
FIG. 3 is an alternate perspective view of FIG. 2.
Figure 4:
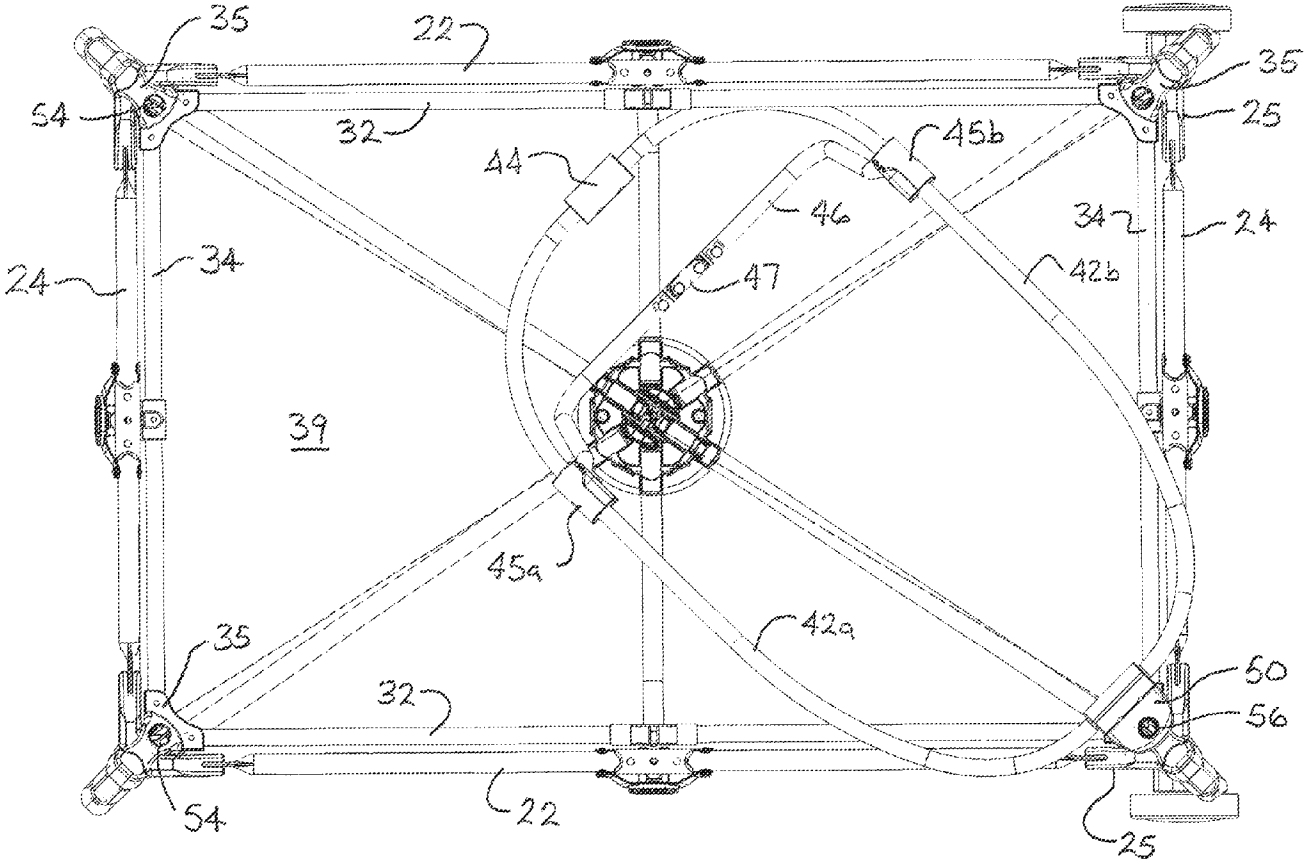
FIG. 4 is a plan view of the accessory and playard frames shown in FIG. 2.
Figure 5:
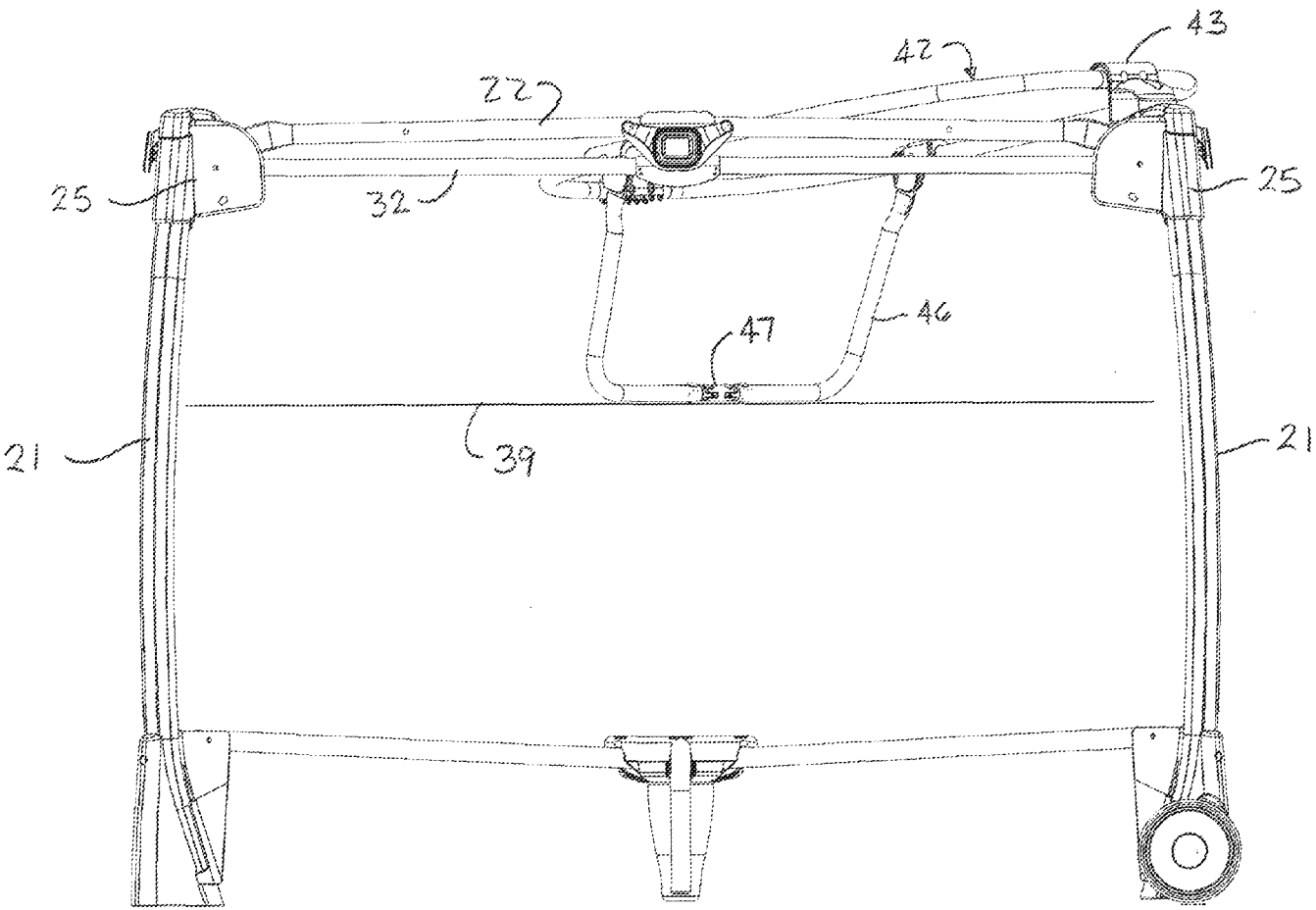
FIG. 5 is side elevation view of the accessory and playard frames shown in FIG. 2.
Figure 6:
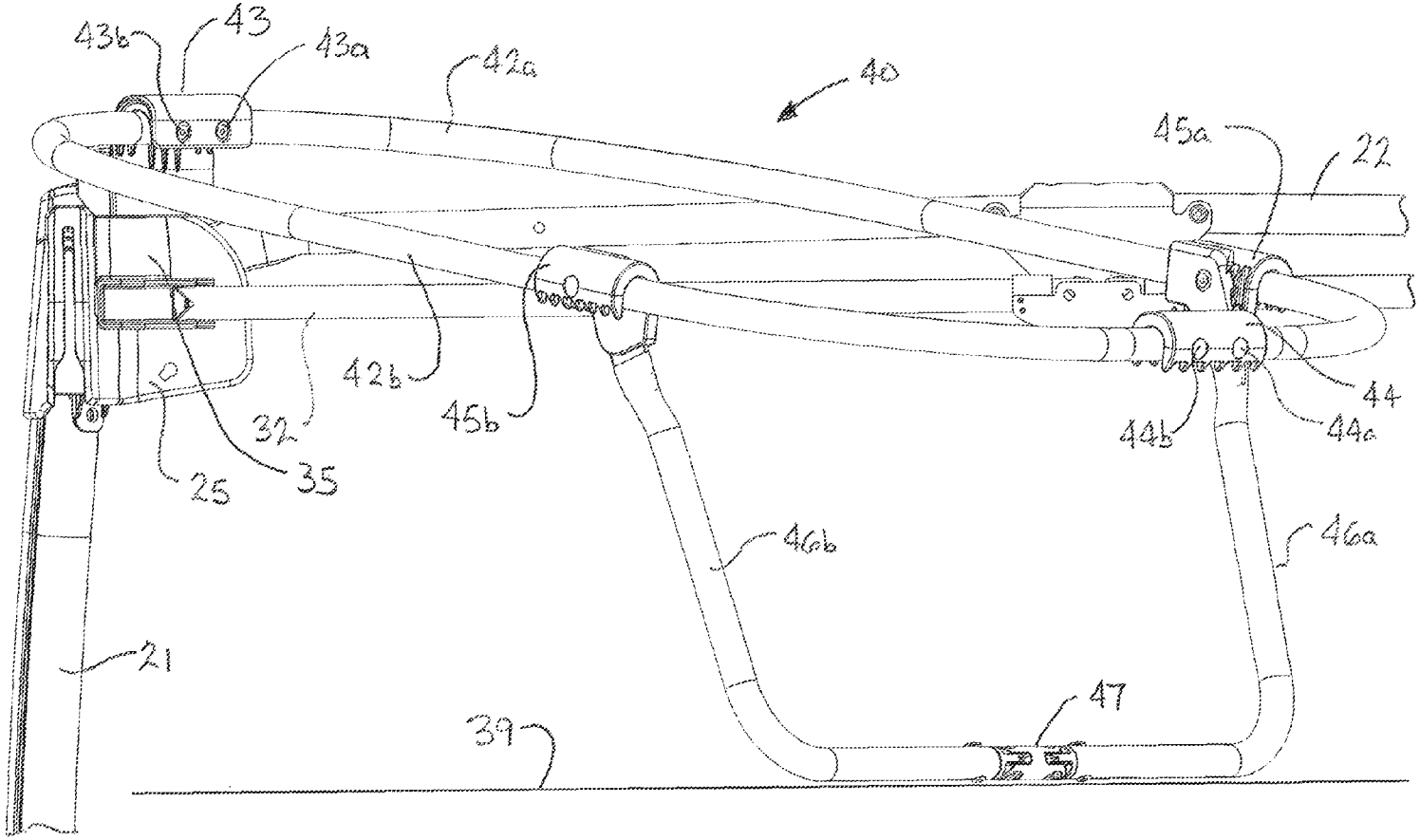
FIG. 6 is an expanded partial elevation view of the accessory frame.
Figure 7:
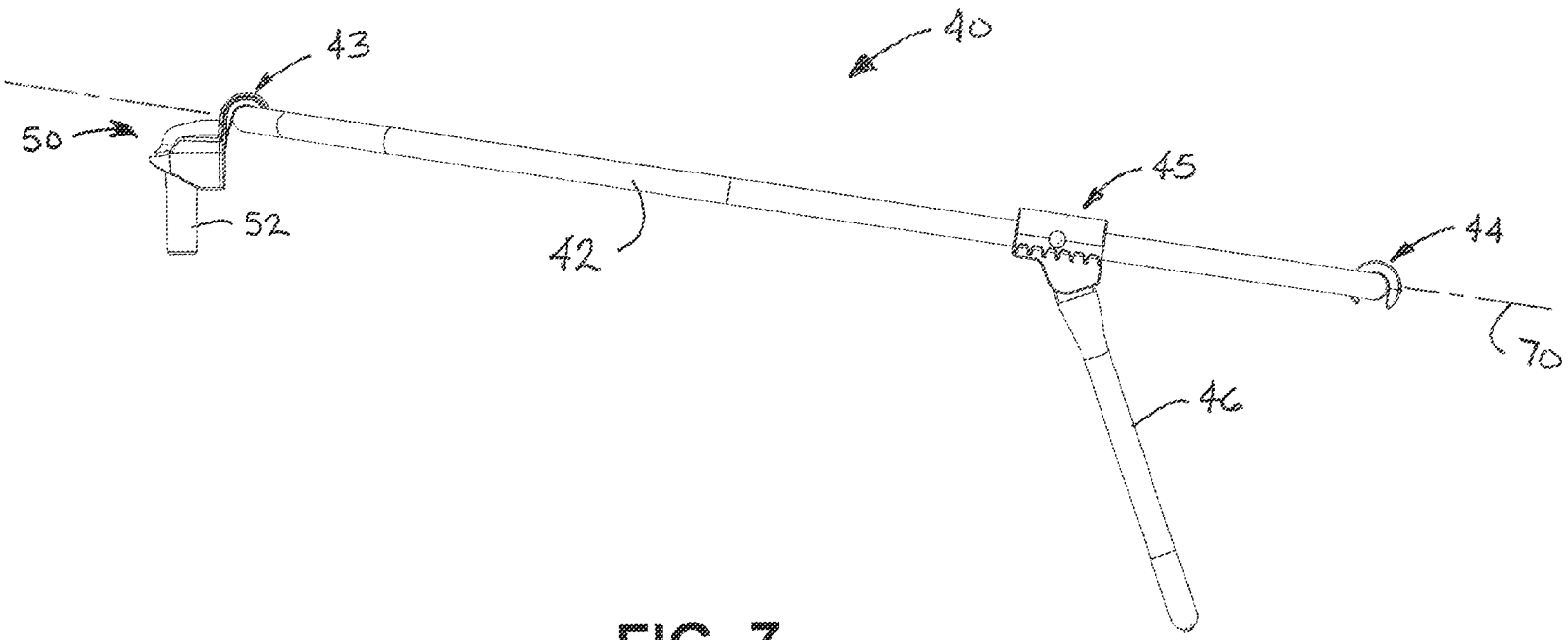
FIG. 7 is a side elevation view of the accessory frame in the deployed position as it would be during use.
Figure 8:
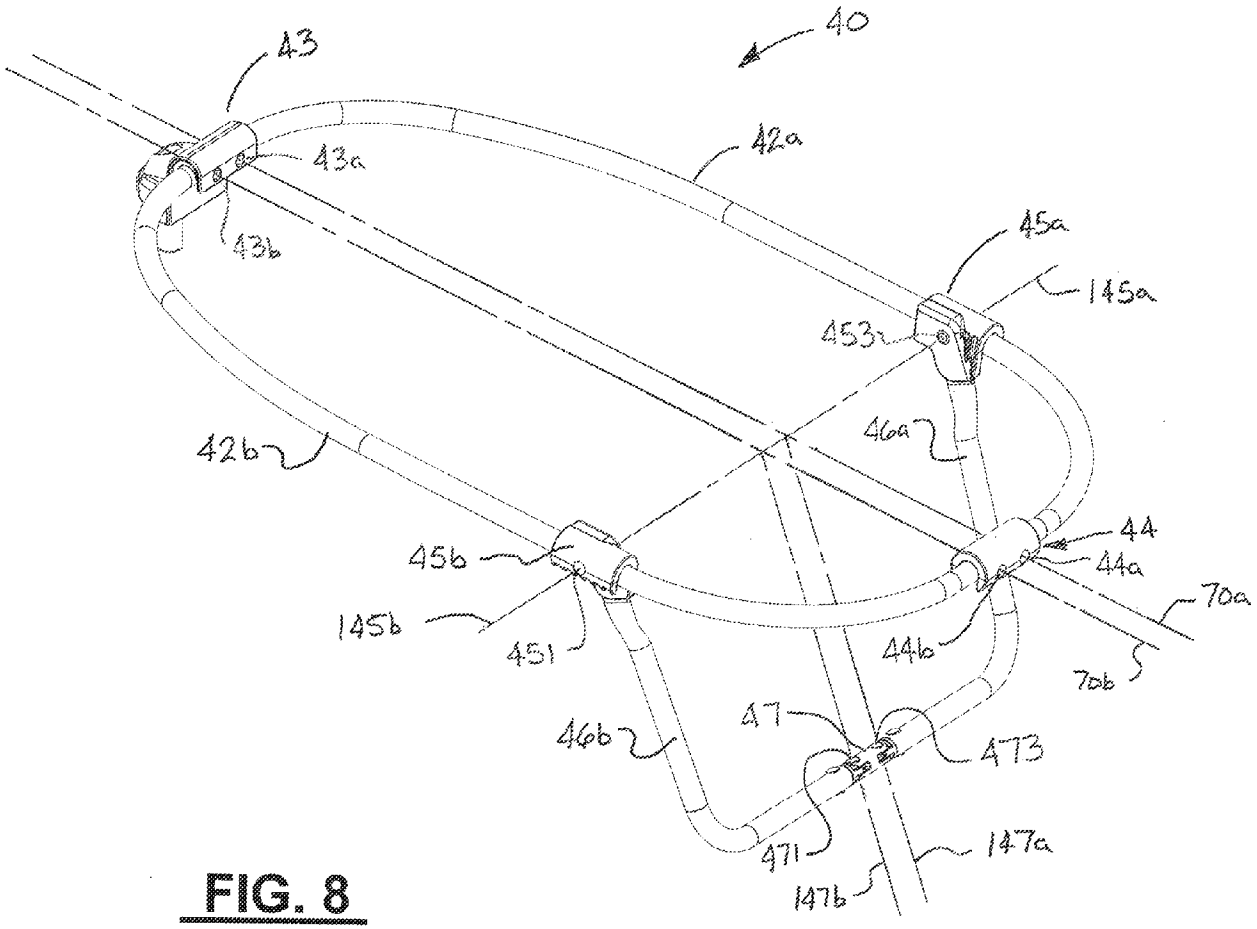
FIG. 8 is a perspective view of the accessory frame shown in the deployed position.

Referring to the figures, an exemplary playard 10 on which the principles of the present invention are beneficial is shown in FIG. 1 comprising an upstanding frame structure 20 covered by a fabric body 100 defining side walls and a floor to contain a small child while leaving the area within the upper perimeter of the frame open. The frame structure 20 includes a pair of generally opposing and spaced-apart upper side rails 22 and a pair of generally opposing upper end rails 24 disposed between the opposing side rail members to form a generally rectangular upper perimeter of the playard frame structure 20. The upper side rails 22 are typically connected to the upper end rail members 24 and other structural members, such as upright legs 21 and corner brackets 25 to define the playard frame 20 and a space therein. It is well known, though not shown in detail, to include movable joints and folding connections in the playard frame 20 that allow the playard to be collapsed for portability. Portable playards in the style of the exemplar presented are well known in the art and not discussed in further detail herein. Numerous playard accessories to enhance convenience for the caregiver are configured for attachment adjacent the upper perimeter frame.

For clarity of description of the present invention, the playard 10 is shown in an erected position as it would be deployed for use of the invention.

Referring to FIGS. 2 through 6, a bassinet frame 30 is shown installed for use in the playard frame 20. The bassinet frame 30 comprises a pair of side frame members 32 and a pair of end frame members 34 generally perpendicularly oriented thereto and held in relation by corner connectors 35. The bassinet frame 30 is typically supported by the upper corner brackets 25 of the playard frame 20 or by the upper side and end rails 22, 24 to position a floor 39 of the bassinet slightly below the plane of the upper frame perimeter 28 of the playard, typically a distance of one foot below. In the embodiment illustrated, bassinet corner connectors 35 are configured to engage the playard corner brackets 25 to support the bassinet 30 in a deployed position for use.

Now referring to FIGS. 7 through 10 in conjunction with FIGS. 2 through 6, a foldable napper frame 40 is shown comprising a support frame rail 42 having first and second rail portions 42*a*, 42*b*, the rail portions being connected by a pair of rail folding hinges 43, 44. The rail portions are generally symmetrical, being mirror imaged about the longitudinal folding axis 70. The folding hinges are disposed to allow the rail 42 to be generally symmetrically folded about a longitudinal folding axis 70 and moved between an open position, shown in FIGS. 8 and 9, and a folded position, shown in FIG. 10. The napper frame 40 further comprises an upper support 50 which is configured to engage one of the corner connectors 35 of the bassinet and a lower support 46 which rests upon the floor 39 of the bassinet 30 to support and laterally stabilize the napper frame 40 in a useful position.

The upper support 50 comprises an engaging structure 52 which is configured to engage a receptacle 54 provided in one or more of the bassinet corner connectors 35. In the preferred embodiment, the engaging structure 52 is a tenon having a circular cross section and the first receptacle 54 is a circular bore of similar diameter in the corner connector 35. Retention features may be provided in the engaging structure and receptacle to prevent inadvertent disengagement. The upper support 50 may further include its own second receptacle 56 for use with a mobile or similar overhead accessory to engage an infant positioned in the napper. Use of a common size standard for the first and second receptacles 54, 56 allows other accessories to be conveniently used with either the bassinet or the napper.

In alternate embodiments, the upper support 50 may be engaged with other suitable structures, such as clamp members secured to the playard or bassinet frame members, to elevate the upper folding hinge 43 appropriately enabling the napper frame 40 to be used in other applications beyond placement in a playard bassinet. In still other embodiments, the upper support is not relied upon to support the napper frame and a pair of lower supports are provided, one adjacent to each end of the frame. Variations in the relative length of the lower supports allows the inclination of the frame rail portions 42*a*, 42*b* to be set to a desired angle for comfort of the child.

Figure 9:
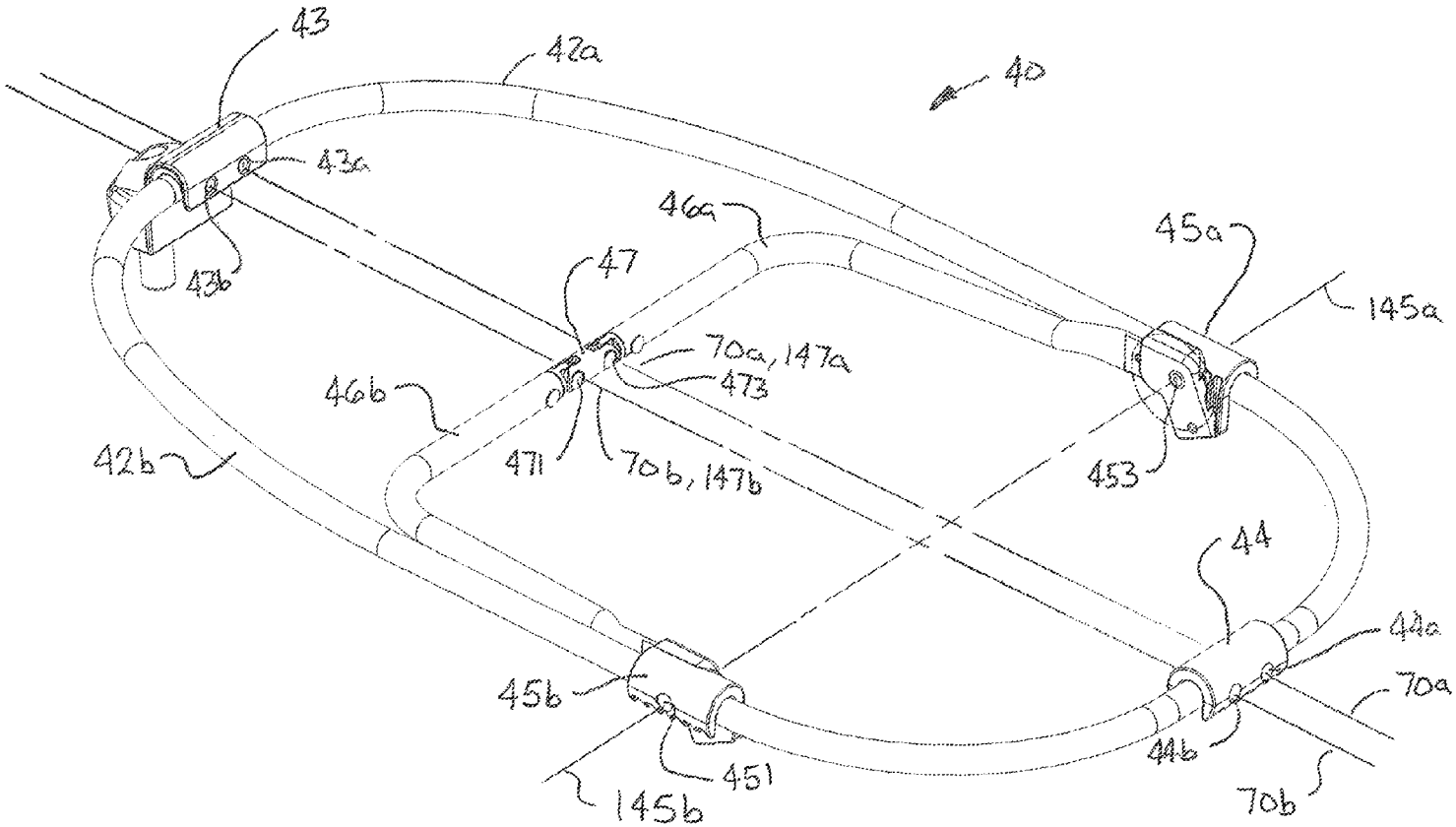
FIG. 9 is a perspective view of the accessory frame of FIG. 8 in which the lower support member has been moved from a deployed position to a folded position in preparation for folding the accessory frame.

The lower support 46 is pivotally connected to the first and second rail portions 42*a*, 42*b* by lower support hinges 45*a*, 45*b* which allow the lower support to pivot about support axis 145 between a locked position (FIG. 8) and a release position (FIG. 9). Lower support 46 includes an intermediately positioned lower support hinge 47 which allows the lower support to be folded under certain frame alignments, discussed in detail hereinafter. A fabric sling may be attached to and supported by the frame rail 42 and configured to cradle an infant when the napper frame 40 is installed in its useful, deployed position.

The napper 40 is preferably installed in the playard only when the bassinet frame is operably positioned in the playard and preferable incorporates features to preclude improper installation and use. A first feature is the incorporation of a receptacle 54 only in the bassinet corner connector 35, and not in the playard corner bracket 25. This assures that the napper frame cannot be improperly installed into a playard alone. Further, the relative orientation of the upper support 50 and the lower support 46 does not allow the napper frame alone to be stably positioned on a surface, best illustrated in FIG. 8. Mounting the napper frame requires a receptacle, such as the one included in the bassinet corner connector 35, or similar stabilizing support positioned above the level at which the lower support rests in order to achieve the necessary stability and proper inclination of the napper for infant comfort.

The napper frame 40 is specifically illustrated in FIGS. 7 through 10, to show the relationship of the hinges and folding axes as those relationships influence folding of the napper frame. Napper frame folding hinges 43, 44 include a pair of spaced-apart hinge points 43*a*, 43*b*, 44*a*, 44*b* to allow the frame to be folded into a flat configuration with planes defined by the first and second rail portions 42*a*, 42*b* being generally parallel and in adjacent contact about the longitudinal folding axis comprising parallel first and second folding axes 70*a*, 70*b*. Alternatively, a single offset hinge pivot points may be employed in all of the folding hinges 43, 44, and 47. Double hinges are preferred in this application for economy and improved flexibility when folding the napper frame 40.

The lower support 46 is pivotally connected to the first and second rail portions 42*a*, 42*b* by lower support hinges 45*a*, 45*b*, positioned on the first and second rail portions, respectively. Lower support hinges 45*a*, 45*b* allow the lower support to 46 pivot about a lower support axis 145 between an open position (deployed), shown in FIGS. 7 and 8, and folded (stowage) position (see FIG. 9) and limit lower support 46 movement between the two positions by travel stops or the like. The lower support 46 may only pivot about lower support axis 145 when the first and second rail portions 42*a*, 42*b* are in the deployed position (FIGS. 8 and 9) which aligns the respective lower support axes 145*a*, 145*b* co-linearly.

Figure 10:
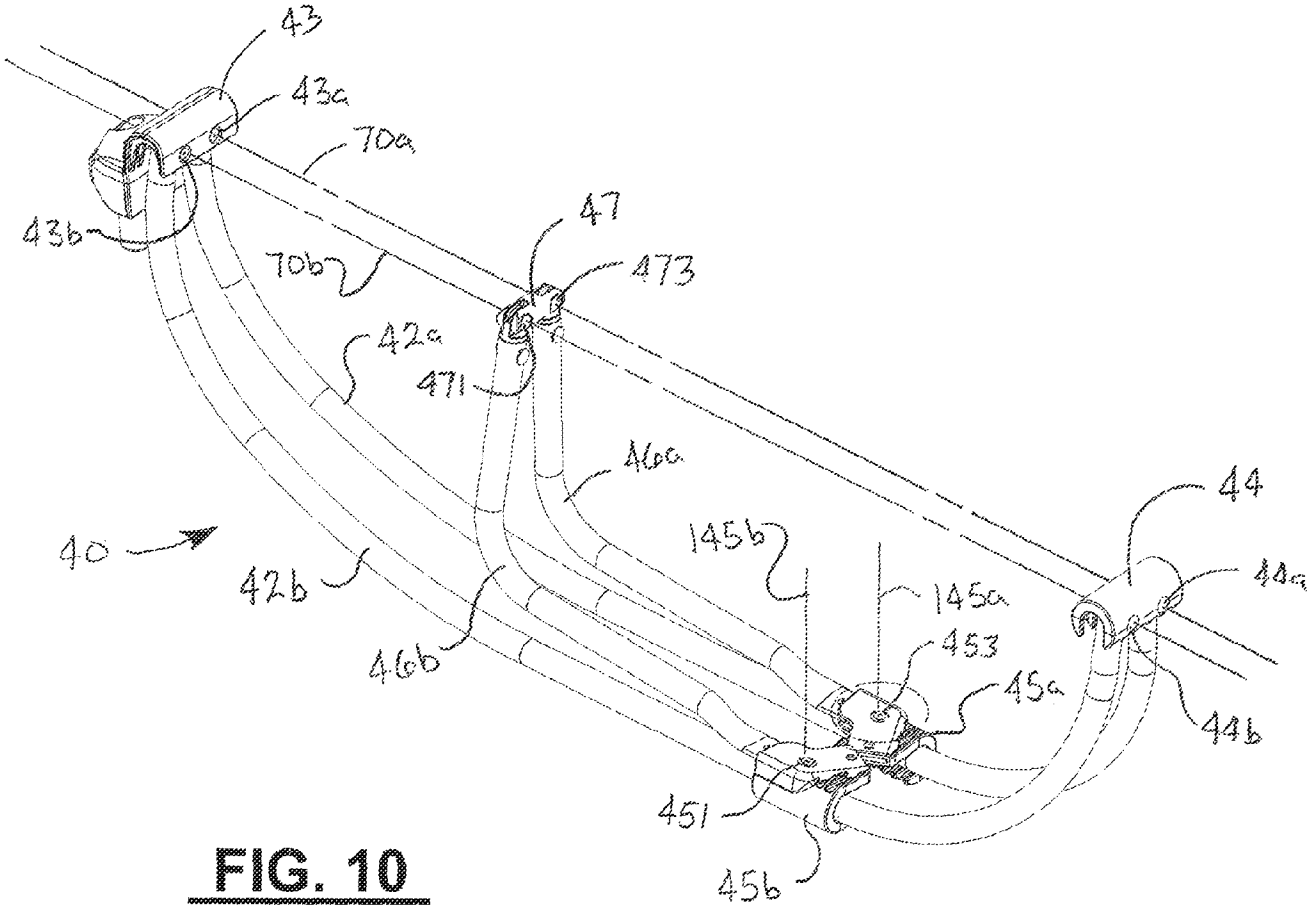
FIG. 10 is a perspective view of the accessory frame of FIG. 9 in which the frame rails have been moved from a deployed position to a folded position configuring the frame into its most compact arrangement.

Moreover, first and second rail portions 42*a*, 42*b* are prevented from pivoting about the first and second folding axes 70*a*, 70*b* while the lower support 46 is in the deployed position due to a non co-linear alignment between the lower support folding axes 147*a*, 147*b* and the first and second folding axes 70*a*, 70*b*. Positioning the lower support 46 in the folded position (FIG. 9) aligns the lower support folding axes 147*a*, 147*b* co-linearly with the first and second folding axes 70*a*, 70*b*, respectively, thereby allowing folding of the frame 40 about the first and second folding axes 70*a*, 70*b* to the fully folded position (FIG. 10). When the napper frame 40 is partially folded as shown in FIG. 9, the co-linear alignment of first and second folding axes 70*a*, 70*b* with the lower support folding axes 147*a*, 147*b* allows the first and second rail portions 42*a*, 42*b* and the lower support portions 46*a*, 46*b* to be folded inwardly, effectively reducing the width of the frame by approximately half. Once the first and second rail portions 42*a*, 42*b* are folded from their generally planar alignment, shown in FIG. 10, the position of the lower support 46 is restrained to preclude unfolding of the lower support while the napper frame 40 is stowed.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A folding frame moveable between an open position for use and a folded position for storage, the folding frame comprising:

first and second frame members being spaced-apart and longitudinally extending, each having a first end and a second end;

upper and lower folding members, the upper folding member pivotally connecting the first ends of respective first and second frame members, the lower folding member pivotally connecting the second ends of respective first and second frame members, the pivoting connections being aligned to enable the first and second frame members to be pivoted about a folding axis between the folded and open positions; and a support member having generally opposing first and second leg ends pivotally connected to the first and second frame members at intermediate pivot points disposed between the respective first and second ends, the pivot points aligned to enable movement of the support member between generally opposing locked and released positions, wherein the locked position is different from the released position and is located substantially below the pivot points;

the support member having a hinge joint with a hinge axis disposed between the first and second leg ends, the hinge axis being co-axially aligned with the folding axis when the support member is in the released position, the hinge axis being angled in relation to the folding axis when the support member is in the locked position thereby preventing pivoting of the first and second frame members about the folding axis.

2. The folding frame of claim 1, wherein the folding axis comprises first and second parallel and spaced apart folding axes, and the hinge axis comprises first and second parallel and spaced apart hinge axes, the first hinge axis and the first folding axis being coaxially aligned and the second hinge axis and the second folding axis being coaxially aligned when the support member is in the folded position.

3. The folding frame of claim 2, wherein respective planes defined by the first and second frame members are generally parallel when the frame members are pivoted to the folded position.

4. The folding frame of claim 1, wherein the upper and lower folding members are offset hinges.

5. The folding frame of claim 1, further comprising a connector disposed on the upper folding member for operably attaching the folding frame to a playard in a manner supporting the upper folding member.

6. The folding frame of claim 5, wherein the connector is configured to limit attachment of the folding frame to the playard to one of a plurality of pre-determined playard configurations.

7. A folding napper frame comprising: a first frame member further comprising first and second frame sections each attached at opposing ends thereof defining a first frame periphery, the first and second frame sections pivotable about a first axis between an open position and a folded position, the first and second frame sections being generally planarly aligned when the first frame member is in the open position and non-planarly aligned when in the folded position; and a second frame member having first and second ends attached to respective opposing points on the respective first and second frame sections for pivotal movement about a second axis, the second axis being generally perpendicularly oriented to the first axis, the second member moveable between a locked position and a released position, wherein the locked position is different from the released position and is located substantially below the pivot points; positioning the second member in the locked position causing the first and second frame members to be aligned in intersecting planes which preclude movement about the first axis, the second frame member having a third pivot axis, the third axis being co-axially aligned with the first axis when the second frame is in the released position thereby permitting movement of the first frame between the open and folded positions.

8. The folding napper frame of claim 6, wherein the pivotal connections about the first axis and the third axis are offset hinges.

9. The folding napper frame of claim 7, wherein the respective planes defined by the first and second frame sections are generally parallel when the first frame is in the folded position.

10. The folding napper of claim 7, wherein the first axis comprises first and second parallel and spaced apart hinge axes, and the third axis comprises third and fourth parallel and spaced apart hinge axes, the first hinge axis and the third hinge axis being coaxially aligned and the second hinge axis and the fourth hinge axis being coaxially aligned when the second member is in the released position.

11. The folding napper frame of claim 10, wherein the respective planes defined by the first and second frame sections are generally parallel when the first frame is in the folded position.

12. The folding napper frame of claim 7, further comprising a connector disposed on the first member distal from on the second member for operably attaching the folding napper frame to a playard.

13. The folding napper frame of claim 12, wherein the connector is configured to limit attachment of the folding napper frame to the playard to one of a plurality of pre-determined playard configurations.

14. A foldable napper frame for fitment on a child's playard, comprising: first and second frame members being spaced-apart and longitudinally extending, each having a first end and a second end; upper and lower folding members pivotally connecting respective first and second ends of the first and second frame members in a manner allowing the first and second frame members to be pivoting about a folding axis between unfolded and folded positions; and a first support member having a first leg end pivotable about a hinge axis and connected to the first frame member and a second leg end pivotable about the hinge axis and connected to the second frame member, the first support member pivotable about an axis generally perpendicular to the folding axis between generally opposing locked and released positions, movement of the first and second frame members about the folding axis being prevented when the first support member is in the locked position and permitted with the support member is in the released position; wherein the folding axis comprises first and second parallel and spaced apart folding axes, and the hinge axis comprises first and second parallel and spaced apart hinge axes, the first hinge axis and the first folding axis being coaxially aligned and the second hinge axis and the second folding axis being coaxially aligned when the first support member is in the folded position.

15. The folding napper frame of claim 14, wherein the upper and lower folding members are offset hinges.

* * * * *